United States Patent [19]

Lamb

[11] 4,001,900

[45] Jan. 11, 1977

[54] SWIMMING POOL COVER HAVING A RAISED LEADING EDGE

[76] Inventor: Joe H. Lamb, 3500 Hillside Lane, Salt Lake City, Utah 84109

[22] Filed: Nov. 10, 1975

[21] Appl. No.: 630,316

[52] U.S. Cl. ..... 4/172.14; 4/172.12

[51] Int. Cl.[2] ..... E04H 3/16; E04H 3/18; F16L 22/02

[58] Field of Search ..... 4/172, 172.11, 172.12, 4/172.14

[56] References Cited

UNITED STATES PATENTS

| | | | |
|---|---|---|---|
| 3,019,450 | 2/1962 | Karasiewicz | 4/172.14 |
| 3,050,743 | 8/1962 | Lamb | 4/172.14 |
| 3,060,455 | 10/1962 | Lamb | 4/172.14 |
| 3,074,079 | 1/1963 | Isaacson | 4/172.14 |
| 3,273,171 | 9/1966 | Lamb | 4/172.14 |
| 3,277,498 | 10/1966 | Kleinbard et al. | 4/172.14 |

*Primary Examiner*—Henry K. Artis
*Attorney, Agent, or Firm*—Richard F. Bojanowski

[57] ABSTRACT

A swimming pool cover constructed from a flexible impervious material wherein the leading or forward edge thereof is raised above the pool's surface. The above swimming pool cover is adapted with a longitudinal or lateral beaded side edge which is slidably held within a longitudinal open channel or track cut into a slideway member mounted to the deck or longitudinal margins of a swimming pool. The leading or forward edge of the cover is also beaded or thickened so that it may be received and held within a track or channel fixed to a bowed tubular member. Fixed to either end of the bowed tubular member are pivotally mounted legs having rotatably mounted tandem wheels fixed thereto. To prevent the bowed member from "rolling" after the pool cover has been extended, an outwardly extending stop member is fixed to the outer wall of each end of the tubular member for contacting one of the leg members and thereby limit the bowed member's "rolling" action. A link chain is fixed to the lower ends of each of the legs of the tandem wheels to limit leg extension. To prevent the pool cover from being overly stressed and thereby inadvertently damaged during use, a pair of side gores are inserted along each of the forward side edges of the pool cover to permit it to be raised without causing excessive stress on the forward section of the pool cover. A third gore is provided in the central, forward section of the pool cover for draining the extended pool cover of any water which may collect thereon.

9 Claims, 7 Drawing Figures

FIG. 1.
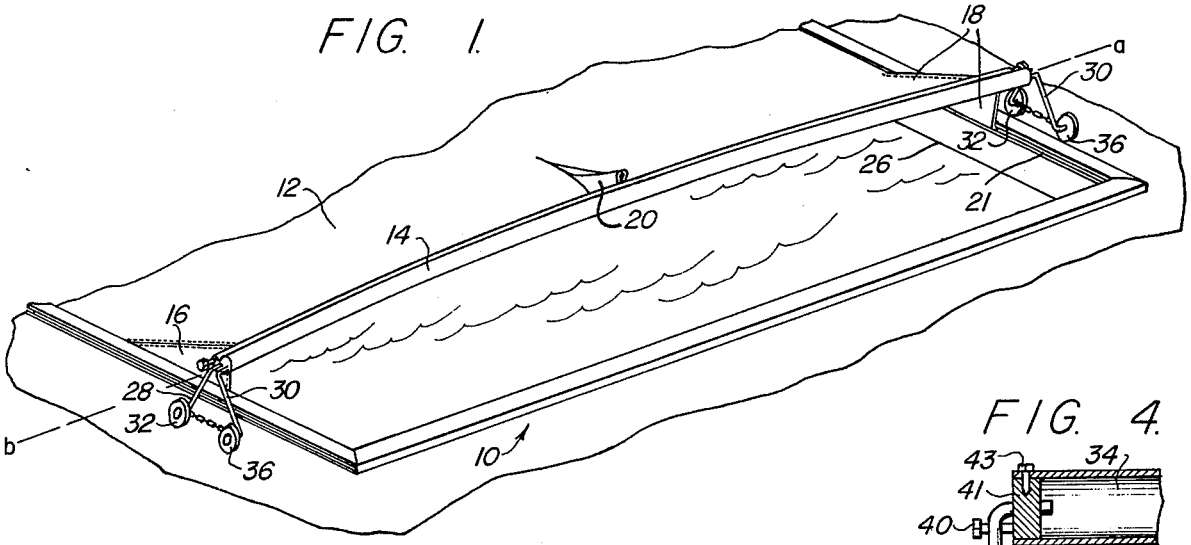
FIG. 4.
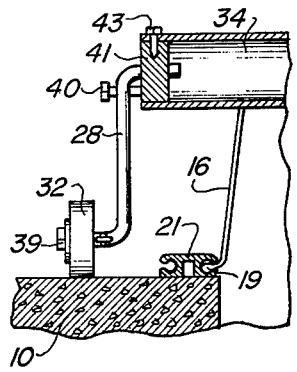
FIG. 2.
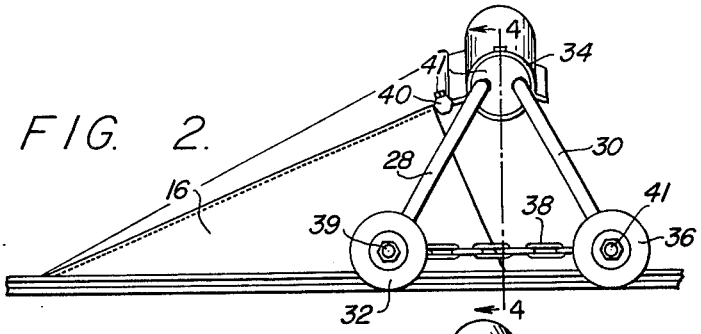
FIG. 3.
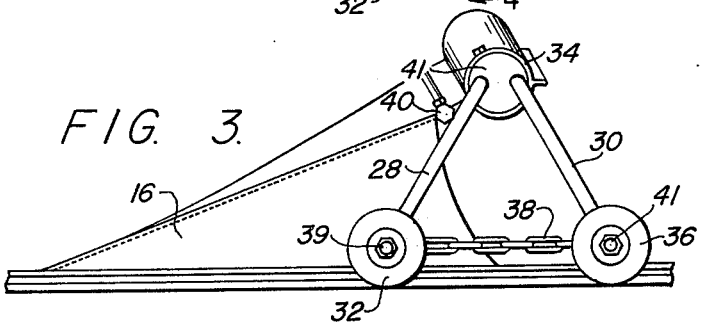
FIG. 6.
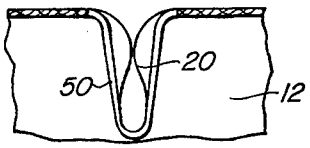
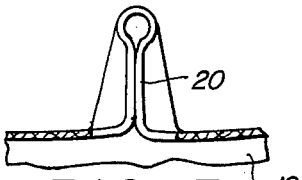
FIG. 7.
FIG. 5.
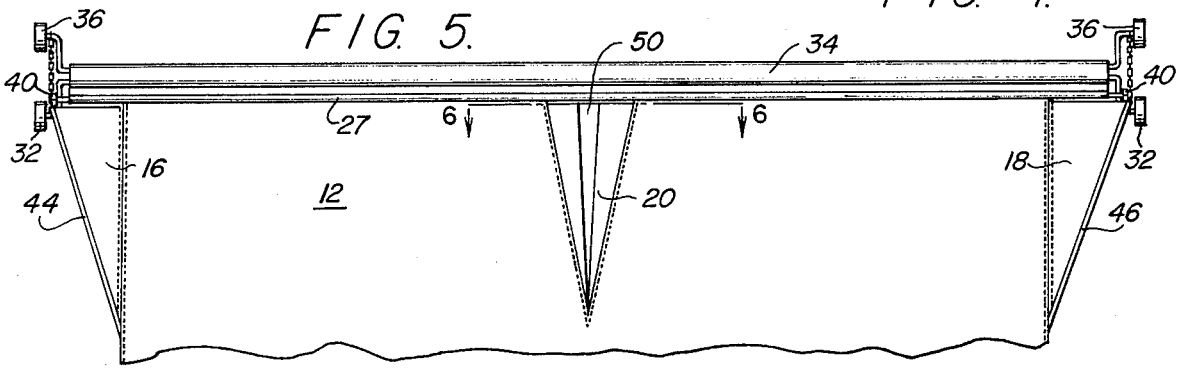

SWIMMING POOL COVER HAVING A RAISED LEADING EDGE

BACKGROUND OF THE INVENTION

1. Field of the Invention

This invention is directed to a pool cover and particularly to a pool cover having a raised leading or forward edge.

2. State of the Art

The use of swimming pool covers on commercial or residential swimming pools is well known. For example, U.S. Pat. No. 3,273,171 discloses a type of pool cover wherein the forward or leading edge of the pool cover is maintained in a raised position.

Pool covers generally increase pool safety and eliminate bugs, dirt, and other debris from entering the pool while it is not in use. Extended pool covers can also reduce heat loss, as well as reduce chlorine and water evaporation from the pool. Algae and calcium build-ups within the pool are also minimized.

When pool covers are used on rectangular shaped pools, the leading edge of the pool cover can be designed to float on the surface of the water as reported in U.S. Pat. Application Ser. No. 619,574 filed on 10/06/75. However, with pools of odd or non-rectilinear configurations, such as kidney shaped pools, a portion of the pool deck necessarily under-lies a portion of the pool cover unless the forward section thereof is raised during extension and retraction. As a result, the pool cover can be damaged from the abrasive effects of dragging the pool cover over a portion of the pool deck. To avoid this problem, the forward edge of the pool cover is normally raised by means of wheeled leg extensions which ride on the lateral margins of the pool deck. By utilizing leg extensions, the forward or leading section of the pool cover is necessarily raised or lifted above the pool deck. In some cases this can create excessive stress and strain on the pool cover and can cause the inadvertent disengagement of the longitudinal beaded side edges from the track or channel strips fixed to the lateral margins of the swimming pool.

OBJECTS OF THE INVENTION

To remedy the above problems, it is a primary object of this invention to provide a swimming pool cover whereby its leading or forward edge is raised above the surface of the water during extension and retraction and thereby permit its use on non-rectilinear shaped swimming pools. Another object of this invention is to provide a swimming pool cover having a leading or forward bowed edge which can be stabilized against "rolling" after it has been extended over the pool cover. Still another object of this invention is to provide a pool cover having side gores which will permit the forward or leading edge of the pool cover to be raised without creating undue stress or tension on the pool cover. A still further object of this invention is to provide a centrally located gore to permit drainage of any water which may collect on the extended pool cover.

SUMMARY OF THE INVENTION

The pool cover of this invention comprises an impervious cover sheet having beaded longitudinal side edges adapted to engage a channeled slide way means or track mounted to the longitudinal side margins of a swimming pool. The leading or forward edge of the pool cover is thickened or beaded to engage a channel or track extending outwardly and rearwardly from an elongated tubular member. Extending downwardly from the ends of the elongated tubular member are pivotally fixed legs to which wheels are journaled for rotation. Preferably the tubular member is bowed upwardly and an outwardly extending stop member is fixed at or near its end sections to prevent "rolling" of the elongated tubular member. A pair of end gores and a central gore are attached to the pool cover to minimize stress and disfiguration during extension and retraction and to facilitate drainage of water from its surface.

BRIEF DESCRIPTION OF THE DRAWING

FIG. 1 is a partial pictorial view showing a conventional swimming pool having a pool cover adapted with a raised leading or forward edge.

FIG. 2 is a side elevation of the forward or leading edge of the pool cover during extension.

FIG. 3 is a side elevation depicting the position of the forward or leading edge of the pool cover after it has been extended over the pool.

FIG. 4 is a vertical cross-sectional view of the forward or leading edge taken along line 4—4 of FIG. 2.

FIG. 5 is a top plan view of the swimming pool cover shown in FIG. 1.

FIG. 6 is a partial sectional view of the central gore section taken along line 6—6 of FIG. 5 wherein the gore is shown in a depressed position.

FIG. 7 is a partial sectional view of the central gore taken along line 6—6 of FIG. 5 wherein the gore is in a raised position.

DESCRIPTION OF THE PREFERRED EMBODIMENT

As shown in FIG. 1 a swimming pool, shown generally by the numeral 10, is adapted with a pool cover 12 having a raised leading or forward edge 14. The pool cover is adapted with a pair of side gores 16 and 18 respectively and a central gore 20. The lateral edges of the pool cover are thickened or beaded so that they can be retained within a track or channeled guide way means 21 (See FIG. 4) fixed to the longitudinal side margins 26 of the swimming pool. The forward or leading edge 14 of the pool cover 12 is likewise thickened or beaded for fixedly attaching same to a channel member 27 extending outwardly and rearwardly from an elongated tubular member 34. A pair of downwardly extending pivotally mounted legs 28 and 30 are attached to each end of the tubular member 34. Rotatable wheels 32 and 36 designed for movement on the pools deck are journaled to the ends of each of the legs 28 and 30. The wheels are positioned in a tandem type of relationship and maintained in its extended tandem position by means of a connecting member, such as a link chain 38, connected at or near the axles 39 and 41 rotatably supporting wheels 32 and 36 to legs 28 and 30 respectively.

During the extension or retraction sequence, sufficient tension is exerted on the forward or leading edge of the pool cover to maintain it in the position shown in FIG. 2, i.e. extended. However, once the pool cover has been extended, the forward or leading edge of the bowed tubular member has a tendency to "roll" or fall downwardly (See FIG. 3). This occurs because the center of gravity of the tubular member would be in a plane above the pivotal points *a* and *b* about which legs 28 and 30 are respectively fixed (See FIG. 1). To prevent the elongated tubular member from rolling forward, an axially positioned stop member 40 is attached to a plug 41 inserted into the ends of tubular member 34. The plug is stationarily held in position by a screw or bolt 43. As shown in FIG. 4, the stop member 40, which can be a bolt or pin fixed to plug 41, comes into contact with leg 28 on partial rotation of tubular member 34.

As previously indicated, the side edge of the forward section of the pool cover 12, is adapted with side gores 16 and 18 respectively. A central gore 20 is also inserted into the pool cover to permit drainage of water from the surface thereof. The side gores comprise a canvas-like material sewed or otherwise attached to the forward side edge of the impervious pool cover 12. The outer edge of the gores 16 and 18 are adapted with a thickened portion or bead 44 and 46 respectively for engagement into the track or channeled guide way means 21 fixed to the deck or longitudinal margins of the swimming pool 10. The gores 16 and 18 are in effect a triangular piece of material sewn or otherwise fixed to the side edges of the pool cover to permit the forward or leading section thereof to be raised above the surface of the pool without creating any additional stress or strain on the pool cover.

The central gore 20 is normally not held by the channel or track fixed to the elongated tubular member and thus can be manually moved downwardly or upwardly as shown in FIGS. 6 and 7 respectively. Since the leading edge 50 of the central gore 20 is not attached to the tubular member, the gore can be moved downwardly (FIG. 6) to form a channeled path from the top surface of the pool cover directly into the pool. With the central gore in a downward position, any water that may be collected on the surface of the pool cover while it is in its extended position can be readily drained therefrom without disconnecting the link chain 38 and thereby lowering the tubular member 34.

When the pool cover is not being drained, the central gore would be in the raised position as shown in FIG. 7. This prevents water contained in the pool from being inadvertently directed onto the surface of the pool cover durng the extension sequence.

To insure that the central gore will be maintained in its upward or raised position, and will not inadvertently fall downwardly, a clip (not shown) or other holding means may be placed over the raised gore.

In operation, the pool cover can be extended or retracted by a motorized means mounted at one end of the swimming pool. During extension of the pool cover, the motorized mechanism is actuated causing the forward or leading edge of the pool cover to be drawn longitudinally from one end of the pool to the other. As the pool cover is being drawn over the swimming pool the forward or leading edge of the pool cover fixed to the bowed tubular member 34 is extended rearwardly as shown in FIG. 2. The tension exerted on the covers leading edge extends the track clamping member which holds the beaded leading edge of the pool cover in a taut extended position. When the motorized means is stopped, the bowed tubular member will tend to fall forward seeking out its own center of gravity and will assume the position shown in FIG. 3. As shown, the stop member 40 comes into contact with the rear leg 30 pivotally fixed to the tubular member 34.

During the extension or retraction sequence, the side gores 16 and 18 will normally be in its fully extended position as shown in FIG. 2. After the cover has been fully extended, the side gores 16 and 18 will relax somewhat as shown in FIG. 3.

If water has been inadvertently collected on the surface of the pool cover, the central gore 20 may be physically moved downward to provide a channel or path which directs the water collected thereon into the pool. In the alternative, a container may be positioned below the central gore for collecting any water collected on the surface of the pool cover. During the extension or retraction sequence, the central gore is normally in a raised position as shown in FIG. 7. This prevents the central gore from scooping or otherwise directing the pool's water onto the surface of the pool cover.

Although certain preferred embodiments have been illustrated and described hereinabove, it should be understood that various changes may be made without departing from the spirit and scope of the disclosed inventive concept which is limited only by the claims appended hereto.

I claim:

1. A swimming pool cover comprising a rasised bowed tubular member, a flexible impervious sheet having a beaded longitudinal side edge and a beaded forward leading edge for engagement into a longitudinal and forward track or channel means respectively, said longitudinal track or channel being mounted to the side margins of a swimming pool and said forward track or channel means being fixed to said bowed tubular member, said bowed tubular member adapted to hold said beaded forward or leading edge, wheeled support members fixed to the ends of said bowed tubular member for maintaining said leading edge of said pool cover in a raised position, and a stop member fixed to the ends of said bowed tubular member for limiting the rolling action of said wheeled support members of said bowed tubular member.

2. The swimming pool cover of claim 1 wherein said flexible impervious sheet includes a pair of side gores fixed to the front section of said flexible impervious sheet.

3. A swimming pool cover of claim 2 wherein said side gores are fixed along one of its sides to aid impervious sheet and said other side of said gore is beaded for engagement into said longitudinal track or channel means.

4. The swimming pool cover of claim 3 including a central gore section wherein said leading edge is detached from said forward track or channel means of said bowed tubular member.

5. The swimming pool cover of claim 2 wherein the ends of said bowed tubular member are fitted with plugs through which said wheeled support members are pivotally fixed.

6. A swimming pool cover comprising a flexible impervious sheet having a beaded longitudinal side edge and a beaded leading edge, and a side gore attached to each forward side section of said flexible impervious sheet.

7. A swimming pool cover of claim 6 including a central gore inserted into the center section and intercepting said beaded leading edge of said flexible impervious sheet.

8. A swimming pool cover of claim 7 wherein said outward side edge of said side gores are beaded.

9. A swimming pool cover of claim 8 wherein said beaded side edges are designed to engage a longitudinal track or channel mounted to the side margins of a swimming pool and said beaded leading edge is designed to engage a track or channel fixed to a bowed tubular member.

* * * * *